US005464677A

United States Patent [19]

Corbin et al.

[11] Patent Number: 5,464,677

[45] Date of Patent: Nov. 7, 1995

[54] PROCESS FOR MANUFACTURING SUBSTANTIALLY 100% NYLON 6 CARPET

[75] Inventors: Thomas F. Corbin; Otto M. Ilg; Robert N. Armstrong, all of Asheville, N.C.

[73] Assignee: BASF Corporation, Parsippany, N.J.

[21] Appl. No.: 289,163

[22] Filed: Aug. 11, 1994

Related U.S. Application Data

[63] Continuation of Ser. No. 753,478, Aug. 30, 1991, Pat. No. 5,370,757.

[51] Int. Cl.[6] ..... B32B 3/02; B32B 3/06

[52] U.S. Cl. ..... 428/95; 428/85; 428/97; 428/99; 428/100

[58] Field of Search ..... 428/85, 95, 99, 428/100, 97

[56] References Cited

U.S. PATENT DOCUMENTS

| | | | |
|---|---|---|---|
| 2,343,174 | 2/1944 | Edison et al. | 260/78 |
| 2,512,727 | 6/1950 | Rice | 154/76 |
| 3,142,611 | 7/1964 | Mills | 161/66 |
| 3,322,606 | 5/1967 | Koller | 161/67 |
| 3,359,934 | 12/1967 | Schwartz et al. | 112/410 |
| 3,834,978 | 9/1974 | Nisonson et al. | 161/81 |
| 3,856,596 | 12/1974 | Shorrock et al. | 156/72 |
| 3,988,406 | 10/1976 | Nakamura et al. | 264/68 |
| 4,028,159 | 6/1977 | Norris | 156/94 |
| 4,035,533 | 7/1977 | Chambley | 428/95 |
| 4,107,160 | 8/1978 | Dicoi et al. | 260/239.3 |
| 4,143,001 | 3/1979 | Raab et al. | 260/2.3 |
| 4,624,878 | 11/1986 | Evans et al. | 428/95 |
| 4,731,274 | 3/1988 | Ishida et al. | 428/87 |
| 5,169,870 | 12/1992 | Corbin et al. | 521/49.8 |
| 5,240,530 | 8/1993 | Fink | 156/94 |

FOREIGN PATENT DOCUMENTS

| | | |
|---|---|---|
| 141275 | 2/1948 | Australia . |
| 753765 | 9/1970 | Belgium . |
| 2032599 | 6/1992 | Canada . |
| 2358492 | 2/1978 | France . |
| 2528458 | 12/1983 | France . |
| 2105137 | 8/1972 | Germany . |
| 9115657.2 | 2/1992 | Germany . |
| 4111455 | 7/1992 | Germany . |
| 51-47166 | 4/1976 | Japan . |
| 61-193829 | 8/1986 | Japan . |
| 1106473 | 3/1968 | United Kingdom . |
| 1306691 | 9/1970 | United Kingdom . |
| 09561 | 10/1989 | WIPO . |

OTHER PUBLICATIONS

Kirk–Othmer, *Encyclopedia of Chemical Technology*, vol. 19, pp. 993–1002.

L. A. Dmitrieva et al., "Regeneration of ϵ–Caprolactam From Wastes In The Manufacture Of Polycaproamide Fibres And Yarns", *Fibre Chemistry*, Mar. 1986, pp. 229–241.

*Primary Examiner*—George F. Lesmes
*Assistant Examiner*—Terrel Morris
*Attorney, Agent, or Firm*—Karen M. Dellerman

[57] ABSTRACT

A process for manufacturing substantially 100% nylon 6 carpet provides a nylon 6 face yarn to a nylon 6 support means so that the yarn and the support means form a carpet having a face side which is displayed when the carpet is installed and a back that binds the face yarn to the support means wherein said binding is with molten or dissolved nylon 6.

2 Claims, 2 Drawing Sheets

PROCESS FOR MANUFACTURING SUBSTANTIALLY 100% NYLON 6 CARPET

This is a continuation of application Ser. No. 07/753,478 filed on Aug. 30, 1991, now U.S. Pat. No. 5,370,757.

FIELD OF THE INVENTION

The present invention relates to carpet production. More particularly, the present invention relates to a carpet construction which is practically completely recyclable.

BACKGROUND OF THE INVENTION

As landfills continue to reach capacity, raw materials are depleted and man recognizes that the earth's resources are limited, more and more materials need to be recycled. Synthetic polymers have long presented problems in recycling due to commingling with other materials as well as apparently irreversible polymerization from which useful raw materials cannot be obtained easily. Certain polyamides, however, are known to be hydrolytically degradable and reusable. Especially, in the case of nylon 6, the monomeric starting materials are claimed from waste polymer and used in the manufacture of manmade fibers. The literature reveals procedures for reclaiming such monomers and polymers. L. A. Dmitrieva et al., "Regeneration ϵ-caprolactam from Wastes in the Manufacture of Polycaproamide Fibres and Yarns", *Fibre Chemistry*, March 1986, pp. 229–241, describes methods for reclaiming polycaprolactam (nylon 6) waste.

There are generally two methods for reclaiming nylon 6 waste. The first involves reprocessing the waste nylon 6, for example, via extrusion to form useful articles. This concept is demonstrated in U.S. Pat. No. 4,143,001 to Raab et al.

The second method involves chemical regeneration through depolymerization. Processes for depolymerizing solid polyamide waste are known. For example, U.S. Pat. No. 2,343,174 to Edison et al. shows general hydrolytic degradation using steam. U.S. Pat. No. 3,988,406 to Nakamura et al. shows the recycling of polyamide waste by heat depolymerization.

Among the polyamides depolymerized for re-use of the monomer is nylon 6. For example, U.S. Pat. No. 4,107,160 to Dicoi et al. describes reclamation of solid nylon 6 waste accumulated during the end processing of nylon 6, low molecular weight oligomers and residual monomer from the polycondensation of caprolactam.

Although the motivation for reclaiming raw materials from waste polymer or spent polymeric products is well recognized, some products as noted do not readily lend themselves to recycling. Especially, items which are composites of several materials present problems. Along these lines, polymeric materials formed into carpets present an interesting reclamation problem. This is due, in part, to the variety of materials present in conventional carpet and the manner in which they are intimately combined. In conventional carpets, the tufts are often nylon 6, while the backing of a nylon 6 tufted carpet may include jute, polypropylene and latex, among other things. Also, the latex may contain fillers such as calcium carbonate, clay or hydrated aluminum. The chemical and physical nature of these materials is such that reclamation of ϵcaprolactam from nylon 6 carpets has traditionally been considered too complex, too expensive and too cumbersome to be practical.

In addition, nylon 6 has a relatively narrow range where the polymer is thermally formable yet not melted. This property of nylon 6 makes nylon 6 items harder to manufacture than, for example, polypropylene which has a much broader range of thermal formability. Articles which are composites of various nylon 6 parts integrally combined have remained complicated to make.

SUMMARY OF THE INVENTION

Accordingly, the present invention is a process for manufacturing substantially 100% nylon 6 carpet comprising providing a nylon 6 face yarn to a nylon 6 support means so that the yarn and the support means form a carpet having a face side which is displayed when the carpet is installed and a back; and binding the face yarn to the support means wherein said binding is accomplished with molten or dissolved nylon 6.

It is an object of the present invention to provide an improved nylon 6 carpet construction.

Related objects and advantages will be readily apparent to one ordinarily skilled in the art after considering the following.

DESCRIPTION OF THE PREFERRED EMBODIMENTS

To promote an understanding of the principles of the present invention, descriptions of specific embodiments of the invention follow, and specific language describes the same. It will nevertheless be understood that no limitation of the scope of the invention is thereby intended, and that such alterations and further modifications, and such further applications of the principles of the invention as discussed are contemplated, as would normally occur to one ordinarily skilled in the an to which the invention pertains.

The present invention is a process for manufacturing carpet from substantially 100% nylon 6 materials. According to the invention, a nylon 6 face yarn is provided to a nylon 6 support means so that the yarn and the support means form a carpet. The face yarn is bound to the support with molten nylon 6 sufficiently to provide sufficient tuft bind. That is, the tufts cannot be pulled out with a force substantially less than the breaking strength of the yarn itself. This is to assure that the face yarn is not removed from the support by mechanical forces that occur during ordinary use such as traffic, vacuuming and shampooing.

Figure 1:
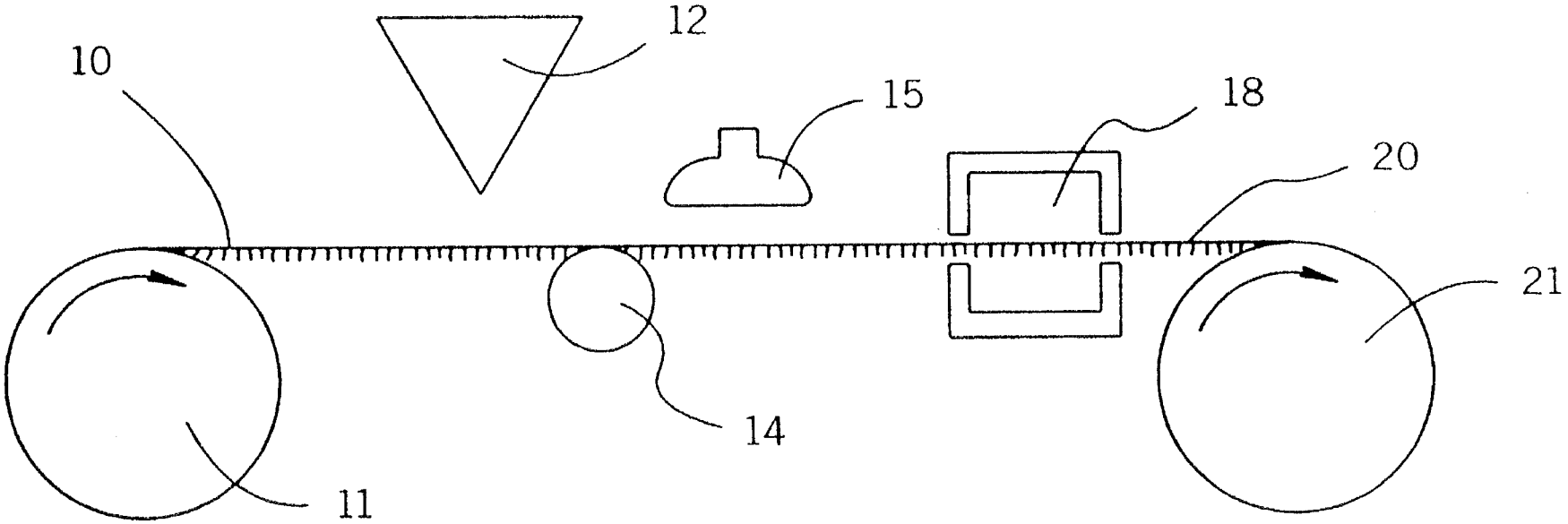
FIG. 1 is a schematic of a process according to a first embodiment of the present invention.

FIG. 1 is a schematic of the process of the present invention. In FIG. 1, unbound carpet 10 is provided from feed roll 11. Unbound carpet 10 is composed of a nylon 6 support web or other nylon 6 support structure into which nylon 6 face yarn is commonly tufted or woven. Unbound carpet 10 is supplied face side down so that the back of the carpet is on top. Unbound carpet 10 is then subjected to binding means 12 which supplies nylon 6 backing to the carpet. The backing material may have a number of different forms. For example, the backing may be a nylon 6 film, nylon 6 powder, one nylon 6 portion of a hook and loop closure, a nylon 6 solution or a nylon 6 melt. In general, the backing is affixed by binding means 12. The face yarn, the support material and backing will become integrally a part of one structure which is the carpet.

More specifically, binding means 12 may be a textured calendaring roll which is maintained at a temperature sufficient to spot melt nylon 6 at the raised points where the textured calendar roll contacts the carpet. Roll 14, which optionally may be chilled, may be present on the face yarn side of unbound carpet 10 to prevent the face yarn from being effected by the heat from the calendar roll. Calendaring is more advantageous when the carpet is woven rather than tufted because of the nature of the two materials. Woven carpet can be spot melted and have sufficient strength to prevent the face yarn from coming unraveled. On the other hand, each tuft of a tufted carpet should be bound into the support structure.

Another method of binding is by presenting molten nylon 6 film to back unbound carpet. In the film method of binding, chill roll 14 is optionally used to prevent overheating and melting or deformation of the face yarn. In this method, binding means 12 may be an extruder extruding molten nylon 6, such as filament or film, onto the back of the unbound carpet. The molten nylon 6 solidifies on the back of the carpet in such a manner that the tufts are sufficiently bound into the support means. Alternatively, pre-made nylon 6 film may be placed on the back of the unbound carpet. Heat source 15 heats the film to at least the stick point of the nylon 6 in the film. The molten nylon 6 binds the face yarn to the support material.

There are several methods of heating the pre-cast film. For example, heat source 15 can be a heated calendar roll which is maintained at a temperature just sufficient to melt the nylon 6 film. Also, heat source 15 can be a direct flame or infrared radiation used almost immediately followed by cooling with heat exchanger 18.

Another manner of binding the carpet to the support material is by supplying a nylon powder to the back of carpet, then heating the nylon powder to its melting point in much the same manner as the film. In this embodiment, binding means 12 becomes a powder funnel which supplies powder to the back of carpet, then heat source 15 is used.

Yet another method of binding the face yarn into the support material is accomplished by solution coating the back of the carpet with a solution containing nylon 6 and a liquid including at least one solvent for nylon 6. For example, the carpet backside may be wet with a thin film of formic acid or acetic acid just prior to adding nylon film or powder. The combination is then, optionally, passed through calendar rolls to enhance adhesion. A nylon fabric which may be woven or nonwoven is preferred over nylon film. The porosity of the fabric aids in solvent removal during the next step of the process. In this binding method, the solution coated carpet is then heated by heat exchanger 18 to remove the solvent from the solution, thus leaving behind nylon 6. In operation, the solution coating which contains at least a solvent or softener for nylon 6 partially solvates or softens the support material and face yarn so that the backing, face yarn and support material coalesce to some extent. Then when the solvent is removed, the face yarn is left bound into the support material.

In all binding methods, to enhance adhesion the carpet and backing may be passed through calendar rolls while the molten or partially dissolved nylon is flowable.

After the binding step where the backing material is supplied, bound carpet 20 is taken up on roll 21. Carpet 20 may be subjected to any conventional treatment such as dyeing, stain inhibition, etc. Typically, however, dyeing should be done prior to the binding step. In dyeing, liquids must flow through the carpet. This flow of liquid may be impeded by a non-porous backing. Spray and foam treatments are generally done after binding. Installation may be according to any method suitable for conventional carpet.

It is, of course, highly desirable in some instances to give dimensional stability to carpet 20 by providing an additional backing. Such additional backing may be, for example, a molten nylon 6 film containing a foaming agent. This film is extruded onto the carpet back and maintained in a molten state sufficiently long to allow the film to develop a foam. Concurrently, the film develops an adhesive bond to the back of the carpet.

In another aspect of the process of the present invention, the need for additional backing can be eliminated completely by supplying enough coating, film, powder or other nylon 6 backing material to bind and provide dimensional stability to bound carpet 20. This type of carpet is then completely nylon 6. The nylon 6 carpet prepared by the present invention is more readily recycled than conventional carpets which contain jute, latex, urethane and other primary and secondary backing materials.

Another embodiment of the present invention involves a carpet made of 100% nylon 6. This carpet can be prepared as described above with the process of the present invention. The resulting carpet has nylon face yarn and primary backing. It is also possible to provide carpet, as described above, having no additional backing if the nylon backing material is provided in sufficient quantity to provide dimensional stability to the carpet.

Figure 2:
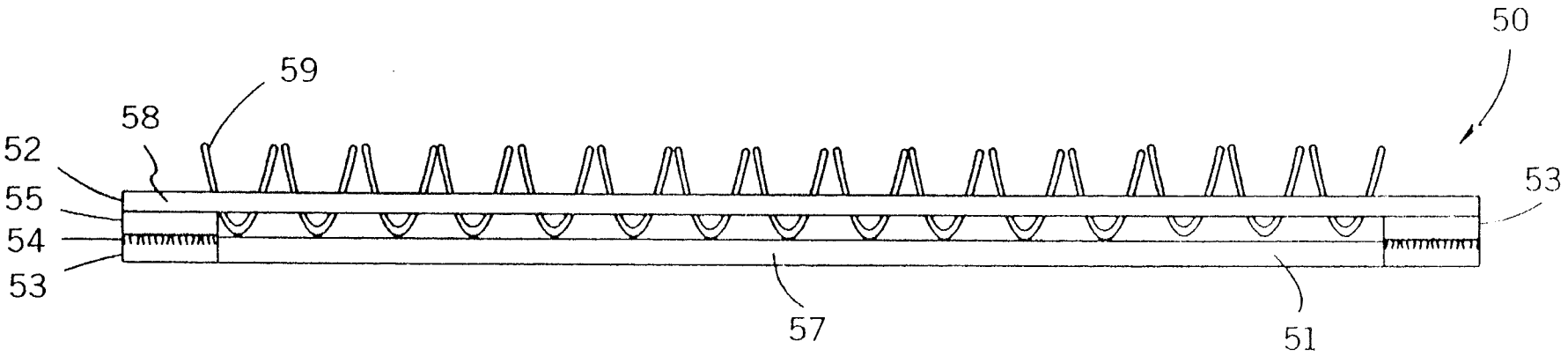
FIG. 2 is a side view of a carpet according to a second embodiment of the present invention.

A further aspect of this embodiment of the present invention is shown in FIG. 2. Carpet 50 is provided in two sections, bottom section 51 and top section 52. Bottom section 51 and top section 52 are not permanently connected. Rather, they are removably held together with fasteners 53. Fasteners 53 may be hook and loop type fasteners, such as Velcro®, wherein one portion 54 of the fastener is part of bottom section 51 and the second portion 55 is part of top section 52. Second portion 55 is of nylon 6 so that the entire top section is nylon 6 and recyclable.

Bottom section 51 includes padding 57. Padding 57 may be, for example, a nonwoven nylon 6 mat.

Top section 52 includes support structure 58 and face yarn 59. Although face yam 59 is shown as tufts, it could be woven. Top section 52 may be constructed in accordance with the process of the present invention to provide a 100% nylon top section. The top section is easily removable for replacement without damaging the bottom section. After removal, the top section can be recycled to ε-caprolactam for reuse in nylon 6 carpet or other nylon 6 products. New carpet of the same type is easily installed.

The invention will be described by referring to the following detailed examples. These examples are set forth by way of illustration and are not intended to be limiting in scope.

EXAMPLE 1

A 1050 denier, 68 filament, bulked continuous filament (BCF) nylon 6 carpet yam with a trilobal cross-section is produced by a conventional process. In a subsequent twisting process two of these yarns are plied and twisted to a balanced twist of about 4.3 turns per inch. After heatsetting the resulting two-ply yarn at 260° F. (127° C.) in a Superba continuous heatsetting machine, the yarn is used for the construction of an all nylon 6 carpet.

A primary backing of a weight of 180 g/m$^2$, woven from nylon 6 split film tapes of 0.11 mm thickness and 1.36 mm width, is used as a primary support means for the BCF face fiber. The split film is produced by a conventional split film process, whereby nylon 6 of a relative viscosity of 4.05 is extruded onto a chill roll through a film die head, cut with a set of rotary knives and the resulting tapes are drawn and oriented uniaxially in a hot air oven and wound up separately. The fabric is woven by known weaving processes such as those used for the manufacture of woven fabrics of the prior art for conventional primary backing from polypropylene or fabrics for sandbags.

A cut pile carpet with 42 ozs/yd$^2$ and ½ inch pile heights is constructed on a 1/10 gauge tufting machine. The carpet is subsequently dyed to the desired shade and finished in a conventional batch dye process. The dyed and finished carpet is then unrolled at a solution coating machine and coated on the side of the primary support means with a solution of 8 parts of nylon 6 having a relative viscosity of 2.43 in a mixture of 46 parts of acetic acid and 46 pans formic acid (80% aqueous). The speed of the carpet passing across the roller coater is 12 meters/rain and the doctor blade at the roller coater is adjusted to obtain a 0.1 mm thick continuous layer of nylon 6 (after drying) as a secondary binding layer. The solvents are removed immediately following the application of the nylon 6 solution in a circulating hot air oven at a drying temperature of about 110° C. and the backcoated carpet is wound up on a roll winder. The solvents are recovered from the drying oven and reused for the preparation of the nylon 6 solution.

EXAMPLE 2

A nylon 6 carpet yarn, primary backing and cut pile carpet are made according to Example 1 except that the dyed and finished unbound carpet is unrolled at a melt coating machine such as those used in making melt coated paper and packaging. Two (2) melt extruders, covering a carpet width of 6 ft each extrude a nylon 6 polymer with relative viscosity of 4.05 through a slot die onto the exposed back of the unbound carpet which passes below the slot die at the speed of 6 m/min to achieve a film thickness of 0.5 mm.

The deposited nylon 6 and resulting carpet assembly is cooled between a set of two (2) chill rolls and wound up on a tension controlled winder.

What is claimed is:

1. A carpet comprising two sections wherein:

a first section is essentially composed of nylon 6 and comprises a pile face of nylon 6 face yarn; a nylon 6 support material into which said nylon 6 face yarn is tufted or woven; a nylon 6 backing which binds said face yarn into said support material where said face yarn is woven or tufted into said support material; and a first fastening means attached to said backing on a side opposite from said pile face, said first fastening means provided for removably and replaceably fastening said support structure with said tufted or woven face yarn bound therein to a fastener of an installation surface; and a second section comprising a second fastening means releasably engagable with the first fastening means of the first section.

2. A carpet comprising a pile face of nylon 6 face yarn; a nylon 6 support material into which said nylon 6 face yarn is tufted or woven; a nylon 6 backing which binds said face yarn into said support material where said face yarn is woven or tufted into said support material wherein each component employed in the carpet is composed substantially of 100% nylon 6.

* * * * *